US005099286A

United States Patent [19]

Nishise et al.

[11] Patent Number: 5,099,286

[45] Date of Patent: Mar. 24, 1992

[54] IMAGE FORMING APPARATUS WITH AND METHOD USING AN INTERMEDIATE TONER IMAGE RETAINING MEMBER

[75] Inventors: Hideya Nishise; Akihiro Nishida, both of Osaka, Japan

[73] Assignee: Minolta Camera Kabushiki Kaisha, Osaka, Japan

[21] Appl. No.: 341,906

[22] Filed: Apr. 24, 1989

[30] Foreign Application Priority Data

| | | | |
|---|---|---|---|
| Apr. 25, 1988 | [JP] | Japan | 63-103436 |
| Apr. 25, 1988 | [JP] | Japan | 63-103437 |
| Apr. 25, 1988 | [JP] | Japan | 63-103440 |
| Apr. 25, 1988 | [JP] | Japan | 63-103441 |
| Apr. 25, 1988 | [JP] | Japan | 63-103442 |

[51] Int. Cl.[5] ..... G03G 15/01; G03G 15/16

[52] U.S. Cl. ..... 355/272; 355/271; 355/326

[58] Field of Search ..... 355/272, 271, 274, 277, 355/326, 327

[56] References Cited

U.S. PATENT DOCUMENTS

| | | | |
|---|---|---|---|
| 3,697,170 | 10/1972 | Bhagat et al. | 355/17 |
| 3,697,171 | 10/1972 | Sullivan | 355/17 |
| 3,893,761 | 7/1975 | Buchan et al. | 355/272 |
| 3,904,406 | 9/1975 | Takahashi | 96/1.4 |
| 3,923,392 | 12/1975 | Buchan et al. | 355/271 |
| 4,187,774 | 2/1980 | Iwasa et al. | 355/271 |
| 4,542,978 | 9/1985 | Tarumi et al. | 355/3 TR |
| 4,652,115 | 3/1987 | Palm et al. | 355/327 |
| 4,690,539 | 9/1987 | Radulski et al. | 355/326 |

FOREIGN PATENT DOCUMENTS

| | | |
|---|---|---|
| 56-147166 | 11/1981 | Japan . |
| 60-33575 | 2/1985 | Japan . |

OTHER PUBLICATIONS

U.S. Patent Application Ser. No. 07/342,358 of Hideya Nishise, et al., filed on Apr. 24, 1989 and entitled Color Image Forming Method.

*Primary Examiner*—R. L. Moses

*Attorney, Agent, or Firm*—Willian Brinks Old Hofer Gilson & Lione

[57] ABSTRACT

An image forming apparatus comprising a toner image retaining member having an electrically conductive substrate and a dielectric layer formed thereon is disclosed. In the image forming apparatus, an electrostatic latent image corresponding to an image of a document is formed on a photoconductive member, and the electrostatic latent image is developed with a toner so as to form a visible toner image on the photoconductive member. Thereafter, in the primary transfer process, the dielectric layer is electrified and the electrified dielectric layer is brought into contact with the photoconductive member so as to transfer the toner image onto the toner image retaining member, and in the secondary transfer process, the transferred toner image is transferred onto a paper.

16 Claims, 13 Drawing Sheets

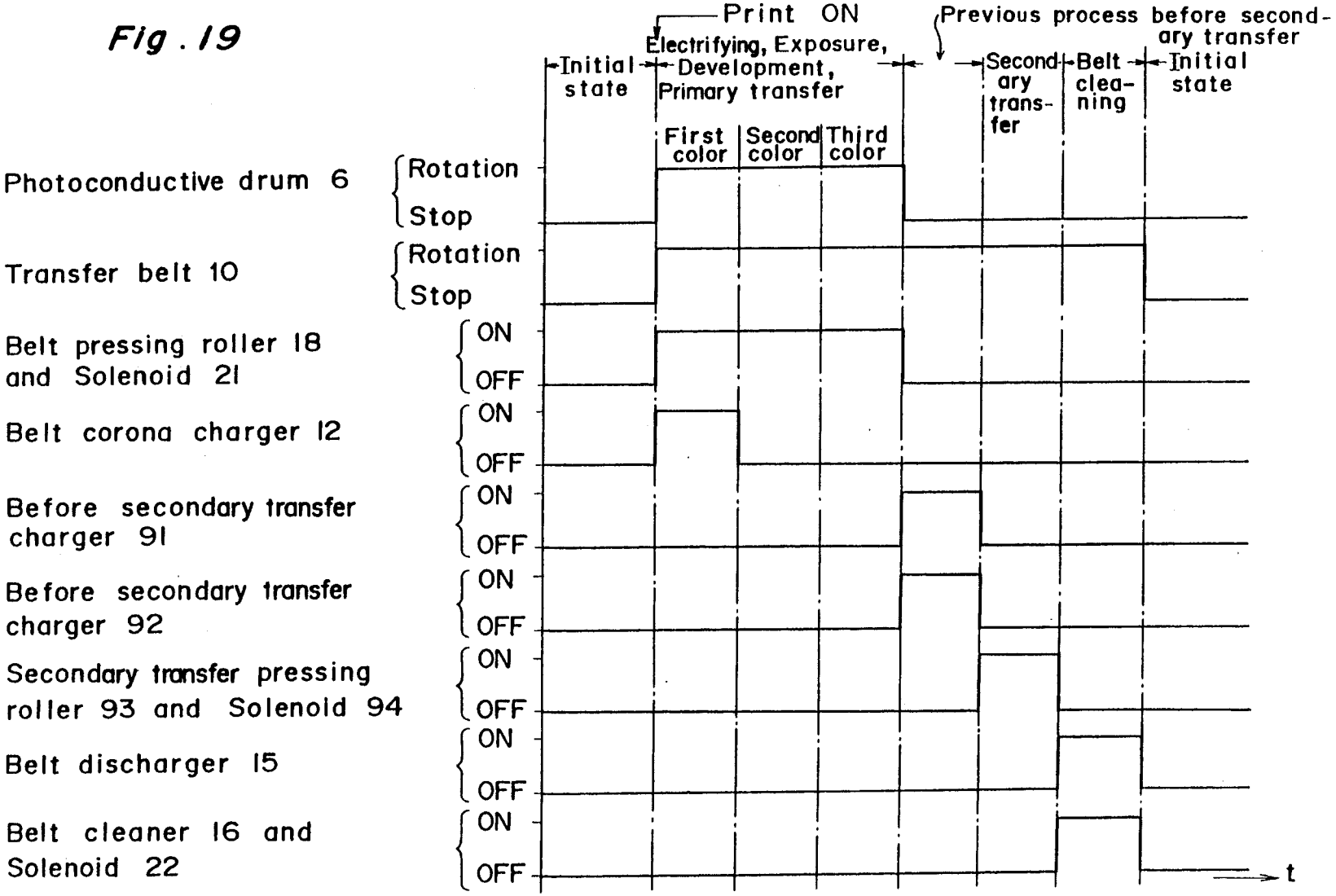
Fig. 19
Photoconductive drum 6
Transfer belt 10
Belt pressing roller 18 and Solenoid 21
Belt corona charger 12
Before secondary transfer charger 91
Before secondary transfer charger 92
Secondary transfer pressing roller 93 and Solenoid 94
Belt discharger 15
Belt cleaner 16 and Solenoid 22
Rotation
Stop
Rotation
Stop
ON
OFF
ON
OFF
ON
OFF
ON
OFF
ON
OFF
ON
OFF
ON
OFF
Initial state
Print ON
Electrifying, Exposure, Development, Primary transfer
First color
Second color
Third color
Previous process before secondary transfer
Secondary transfer
Belt cleaning
Initial state
t

IMAGE FORMING APPARATUS WITH AND METHOD USING AN INTERMEDIATE TONER IMAGE RETAINING MEMBER

BACKGROUND OF THE INVENTION

1. Field of the Invention

The present invention relates to an image forming apparatus, and more particularly, to an image forming apparatus, such as a full color copying machine, comprising a toner image retaining member for retaining a toner image temporarily.

2. Description of the Related Art

A method and apparatus for transferring two toner images on both sides of a copying paper respectively at the same time are disclosed in the Japanese patent publication (JP-B2) No. 54-28740. In the method and apparatus, a first toner image is formed on a photoconductive body at first and the toner image having been formed is transferred on a toner image retaining member primarily. After the transfer of the first toner image onto the toner image retaining member, a second toner image is formed on the photoconductive body. Furthermore, the first toner image transferred primarily from the photoconductive body onto the toner image retaining member and the second toner image formed newly on the photoconductive body are respectively transferred on both sides of a copying paper simultaneously to produce a copy of both sides. However, since an insulator belt is usually used as the toner image retaining member and the toner image formed on the photoconductive body is transferred on the insulator belt by a transfer charger arranged on the back side of the insulator belt, it is difficult to concentrate the action of the transfer charger at the transfer position where the photoconductive body and the insulator belt are in contact with each other, and therefore, portions of the photoconductive body not having passed the transfer position receive undesirable affects from the transfer charger. As the result, the toner image may be spoiled.

Also, a transferring image forming method and a transferring image forming apparatus are disclosed in the Japanese patent laid open publication (JP-A) No. 56-147166. In the method and apparatus, in order to form a plurality of toner images based on a formed electrostatic latent image, after the toner image formed on a charge retaining drum is transferred on an insulator belt primarily by pressing the charge retaining drum onto the insulator belt, the toner image transferred on the insulator belt is transferred on a copying paper secondarily. In the primary transfer process, since the transfer process of the toner image from the charge retaining member onto the insulator drum is performed by pressing both members, it is hard to perform the transfer process of the toner image stably.

Furthermore, an electrophotographic process of transferring colored electrostatic images is disclosed in the Japanese patent publication (JP-B2) No. 49-209. In the electrophotographic process, after respective colors of toner images formed on a photoconductive body are transferred on a toner image retaining drum primarily in multiple processes so as to superimpose the same thereon, the toner image superimposed on the toner image retaining drum is transferred on a copying paper secondarily. In the specification of the above publication, the transfer process for the toner image from the photoconductive body onto the toner image retaining drum is not described concretely.

SUMMARY OF THE INVENTION

An essential object of the present invention is to provide an image forming apparatus which is able to form an image of good quality at all times.

Another object of the present invention is to provide an image forming apparatus which is able to transfer a toner image formed on a photoconductive member onto a toner image retaining member stably at all times.

A further object of the present invention is to provide an image forming apparatus which is able to form respective color toner images on a photoconductive member, and also transfer the toner images onto a toner retaining member stably at all times, only by electrifying the toner retaining member once.

A still further object of the present invention is to provide an image forming apparatus which is able to transfer a toner image formed on a photoconductive member onto an electrified toner image retaining member, and also discharge the toner image retaining member and a copying paper with a simple composition after the toner image formed thereon is transferred onto the copying paper.

A still more further object of the present invention is to provide an image forming apparatus which is able to transfer a toner image formed on a photoconductive member onto a toner image retaining member, and also transfer the toner image formed thereon onto a copying paper properly at all times.

According to one aspect of the present invention, there is provided an image forming apparatus comprising: a photoconductive member; an electrostatic latent image forming means for forming an electrostatic latent image corresponding to an image of a document on said photoconductive member; a developing means for developing the electrostatic latent image with a toner so as to form a visible toner image on said photoconductive member; a toner image retaining member having an electrically conductive substrate and a dielectric layer formed on the electrically conductive substrate, said toner image retaining member retaining a toner image temporarily; a primary transfer means for electrifying the dielectric layer of said toner image retaining member and bringing the electrified dielectric layer into contact with said photoconductive member so as to transfer the toner image formed on said photoconductive member onto said toner image retaining member; and a secondary transfer means for transferring the toner image transferred on said toner image retaining member onto a paper.

According to another aspect of the present invention, there is provided an image forming apparatus comprising: a photoconductive member; an electrostatic latent image forming means for sequentially forming a plurality of electrostatic latent images corresponding to color components of an image of a document on said photoconductive member, respectively; a developing means for developing the electrostatic latent images with toners of different colors so as to form the corresponding visible toner images on said photoconductive member, respectively; a toner image retaining member having an electrically conductive substrate and a dielectric layer formed on the electrically conductive substrate, said toner image retaining member retaining toner images temporarily; a primary transfer means for electrifying the dielectric layer of said toner image retaining member and bringing the electrified dielectric layer into contact with said photoconductive member so as to sequentially transfer the toner images formed on said photoconductive member onto said toner image retaining member so that a color toner image comprised of all the toner images is formed thereon; and a secondary transfer means for transferring the color toner image formed on said toner image retaining member onto a paper.

According to a further aspect of the present invention, there is provided a toner image retaining member for use in an image forming apparatus, comprising: an electrically conductive substrate having a volume resistivity of $10^5$ Ω·cm or less; and a dielectric layer formed on said electrically conductive substrate having a specific inductive capacity of 2 to 4, and a volume resistivity of $10^{16}$ to $10^{17}$ Ω·cm.

According to a still further aspect of the present invention, there is provided an image forming method using a toner image retaining member comprising an electrically conductive substrate and a dielectric layer formed on said electrically conductive substrate, said method comprising steps of: sequentially forming electrostatic latent images corresponding to color components of an image of a document on a photoconductive member; sequentially developing the electrostatic latent images with toners of different colors so as to form the corresponding visible toner images on said photoconductive member; electrifying the dielectric layer of said toner image retaining member once; sequentially transferring the toner images formed on said photoconductive member onto said toner image retaining member after the electrifying process so as to form a color image on said toner image retaining member by superimposing all of the toner images thereon; and transferring the color image formed on said toner image retaining member onto a paper.

According to a still more further aspect of the present invention, there is provided an image forming apparatus comprising: a photoconductive member; an electrostatic latent image forming means for forming an electrostatic latent image corresponding to an image of a document on said photoconductive member; a developing means for developing the electrostatic latent image with a toner so as to form a visible toner image on said photoconductive member; a toner image retaining member formed in a form of an endless belt; supporting means having a plurality of rollers for supporting said toner image retaining member, said rollers including a movable roller movably provided at a position opposing to said photoconductive member so as to selectively bring said toner image retaining member into contact with said photoconductive member; a first transfer means including a charger device provided at a position opposing to one of said rollers for electrifying said toner image retaining member to have a predetermined electric potential, and a driving device for moving said movable roller so as to bring said toner image retaining member into contact with said photoconductive member for transferring the toner image formed on said photoconductive member onto said toner image retaining member; and a second transfer means for transferring the toner image formed on said toner image retaining member onto a paper.

According to an additional further aspect of the present invention, there is provided an image forming apparatus comprising: a photoconductive member; an electrostatic latent image forming means for forming an electrostatic latent image corresponding to an image of a document on said photoconductive member; a developing means for developing the electrostatic latent image with a toner so as to form a visible toner image on said photoconductive member; a toner image retaining member; a first transfer means including a charger device for electrifying said toner image retaining member so as to transfer the toner image formed on said photoconductive member onto said toner image retaining member at a first transfer position; a second transfer means for bringing a paper into contact with said toner image retaining member so as to transfer the toner image formed on said toner image retaining member onto the paper at a second transfer position; and a means arranged at a position between said first and second transfer positions for discharging said toner image retaining member and electrifying the same with an opposite electric polarity to that of the electric charge generated by a friction caused between the paper and said toner image retaining member.

According to an additional still further aspect of the present invention, there is provided an image forming apparatus comprising: a photoconductive member; an electrostatic latent image forming means for forming an electrostatic latent image corresponding to an image of a document on said photoconductive member; a developing means for developing the electrostatic latent image with a toner so as to form a visible toner image on said photoconductive member; a toner image retaining member; a first transfer means including a charger device for electrifying said toner image retaining member so as to transfer the toner image formed on said photoconductive member onto said toner image retaining member at a first transfer position; a second transfer means for bringing a paper into contact with said toner image retaining member so as to transfer the toner image formed on said toner image retaining member onto the paper at a second transfer position; an eraser means arranged on the downstream side of said second transfer means in a transportation direction of the paper for erasing the electric charge electrified on the paper; and a control means for controlling said eraser means so as to erase the electric charge remained on said toner image retaining member after the operation of said second transfer means.

BRIEF DESCRIPTION OF THE DRAWINGS

These and other objects and features of the present invention will become clear from the following description taken in conjunction with the preferred embodiments thereof with reference to the accompanying drawings, in which:

FIG. 19 is a timing chart showing actions of the full color copying machine shown in FIG. 15.

DETAILED DESCRIPTION OF THE PREFERRED EMBODIMENTS

The First Preferred Embodiment

A full color copying machine of the first preferred embodiment according to the present invention will be described hereinafter, referring to the attached drawings.

Figure 1:
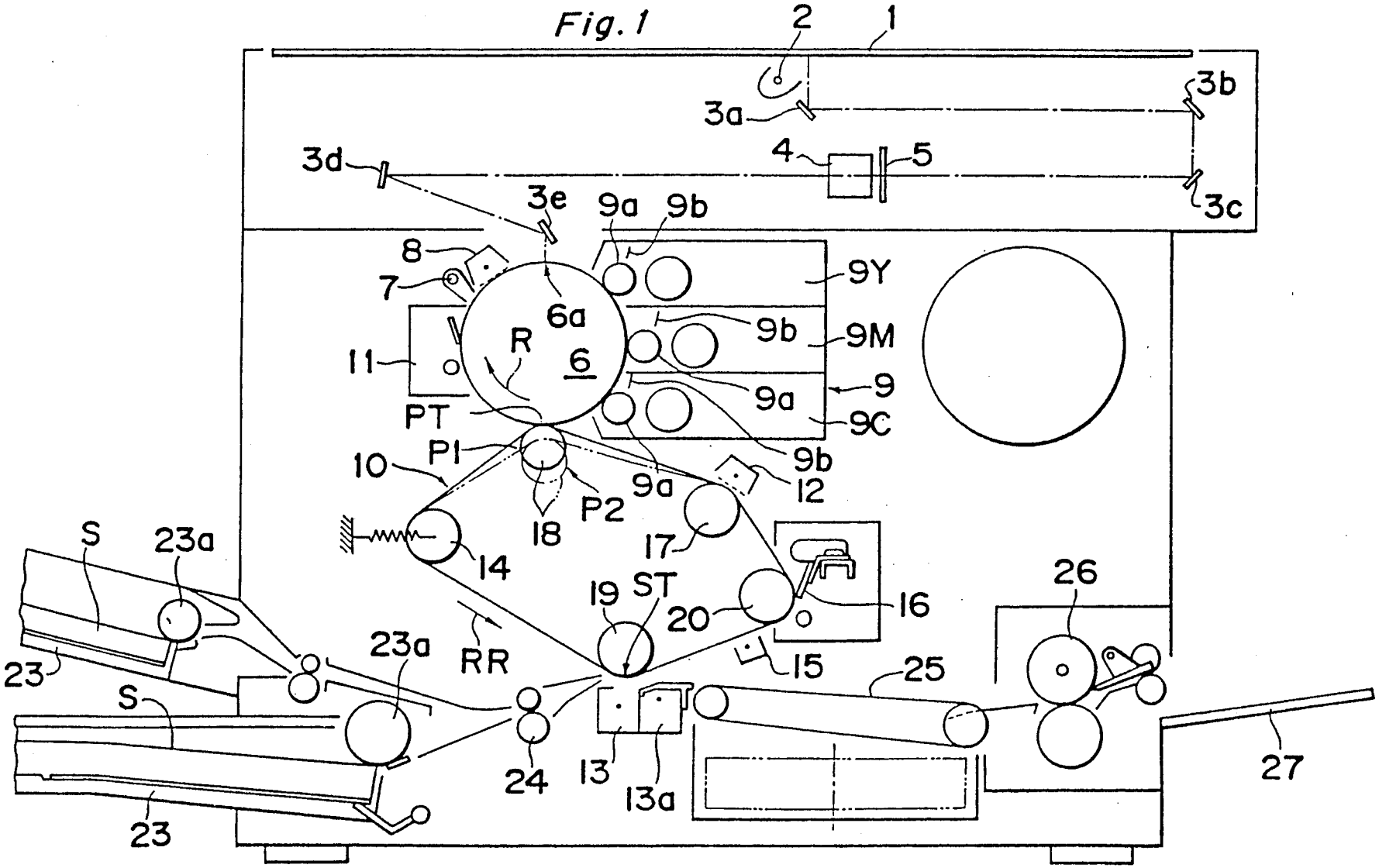
FIG. 1 is a schematic longitudinal cross sectional view showing a full color copying machine of the first preferred embodiment according to the present invention.
Figure 2:
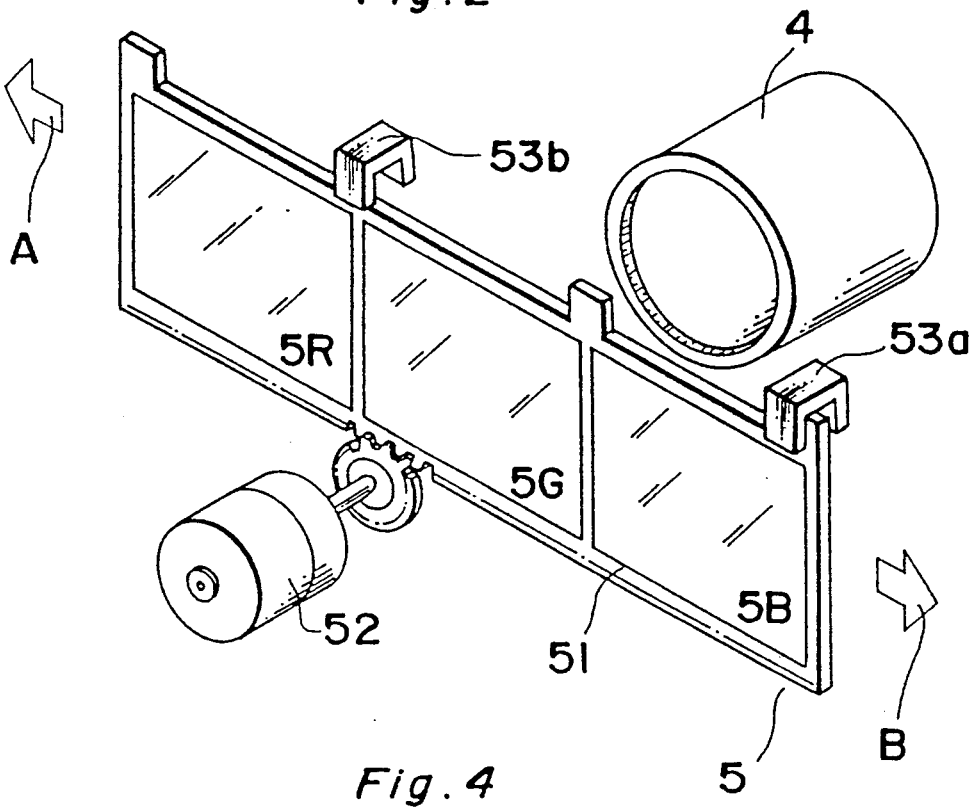
FIG. 2 is a perspective view showing a color filter unit shown in FIG. 1.

In FIG. 1, under a glass document table 1 for arranging a document thereon, there are arranged an optical system comprised of an exposure lamp 2 for illuminating the document arranged on the glass document table 1, first to fifth mirrors 3*a* to 3*e* for guiding a light reflected by the document, a focus lens 4 for focusing the above light passed through a color filter unit 5 on the fourth lens 3*d*, and the color filter unit 5. A photoconductive drum 6 is arranged under the fifth mirror 3*e*. As shown in FIG. 2, the color filter unit 5 is comprised of a blue color filter plate 5B for filtering off a color component of yellow, a green color filter plate 5G for filtering off a color component of magenta, and a red color filter plate 5R for filtering off a color component of cyan, which are supported by a frame member 51 in a vertical plane perpendicular to the optical axis of the focus lens 4. The frame member 51 for supporting the filter plates 5B, 5G and 5R is moved by a driving motor 52 in directions indicated by arrows A and B as shown in FIG. 2, so that selected one of the filter plates 5B, 5G and 5R is positioned on the way of the optical path between the third mirror 3*c* and the focus lens 4 according to position information detected by position sensors 53*a* and 53*b*.

Returning now to FIG. 1, around the photoconductive drum 6, there are arranged an eraser lamp 7, a corona charger 8, a developing section 9, an intermediate transfer belt 10, and a drum cleaner 11, sequentially in a rotation direction of the photoconductive drum 6 indicated by an arrow R. The developing section 9 is comprised of a yellow developing unit 9Y, a magenta developing unit 9M, and a cyan developing unit 9C. Furthermore, respective developing units 9Y, 9M and 9C comprise a developing sleeve 9*a* for supplying each color toner, a scraping shutter member 9*b* arranged at the rear of the developing sleeve 9*a* for scraping off the toner supplied on the developing sleeve 9*a* when the developing unit is not selected as described later in detail, and a toner density detector (not shown) etc. in a known manner.

Figure 4:
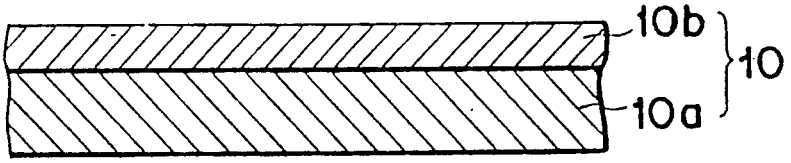
FIG. 4 is a partial cross sectional view of the intermediate transfer belt shown in FIGS. 1 and 3.

As shown in FIG. 4, the intermediate transfer belt 10 is constituted by a flexible looped endless belt comprised of an electrically conductive substrate 10*a* of urethane rubber having a volume resistivity of $10^3$ to $10^4$ Ω·cm, and a dielectric layer 10*b* of polytetrafluorethylene having a volume resistivity equal to or larger than $10^{14}$ Ω·cm which is formed on the upper surface of the conductive substrate 10*a*.

According to an experiment done by the present inventors, when the specific inductive capacity of the dielectric layer 10*b* is equal to or smaller than 2 and the volume resistivity thereof is equal to or smaller than $10^{16}$ Ω·cm, the ability for retaining the electric charge is lowered, resulting in that the electric charge retained on the dielectric layer 10*b* discharges immediately after the electrifying operation. Further, when the specific inductive capacity of the dielectric layer 10*b* is equal to or smaller than 4 and the volume resistivity thereof is equal to or larger than $10^{17}$ Ω·cm, the efficiencies of the electrifying and discharge actions are lowered, resulting in that it becomes hard to electrify or discharge the intermediate transfer belt 10. Furthermore, when the volume resistivity of the conductive substrate 10*a* is equal to or larger than $10^4$ Ω·cm, the conductivity thereof is lowered and the intermediate transfer belt 10 is electrified ununiformly and unstably, resulting in that there are such inconveniences that the drop of the electric potential thereof decreases when a toner image is transferred thereon.

Accordingly, the specific inductive capacity of the dielectric layer 10*b* is preferably in the range from 2 to 4, the volume resistivity thereof is preferably in the range from $10^{16}$ to $10^{17}$ Ω·cm, and the volume resistivity of the conductive substrate 10*a* is preferably equal to or smaller than $10^5$ Ω·cm. In the intermediate transfer belt 10 comprising the conductive substrate 10*a* and the dielectric layer 10*b* satisfying above conditions, the efficiencies of the electrifying and discharge actions are improved, and the electric charge electrified thereon can be retained stably for a relatively long time without any influence of the environment. Accordingly, the intermediate transfer belt 10 can be used effectively as an intermediate transfer body.

Around the intermediate transfer belt 10, there are arranged a belt corona charger 12 for transferring an image formed on the photoconductive drum 6 onto the intermediate transfer belt 10 in the primary transfer process, a secondary transfer charger 13 for transferring an image formed on the intermediate transfer belt 10 onto a copying paper S, a separating charger 13*a*, a belt discharger 15, and a belt cleaner 16.

Figure 3:
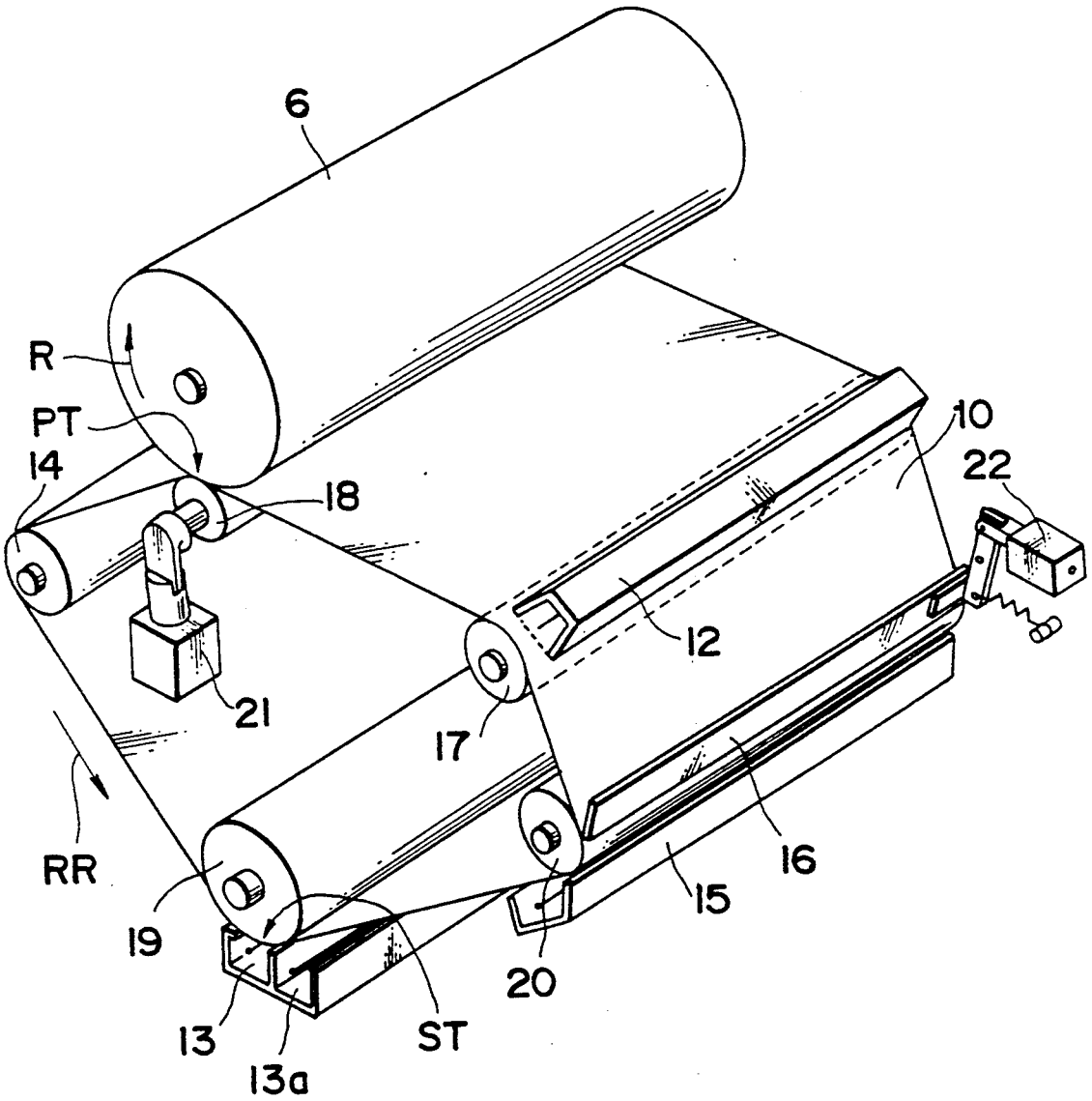
FIG. 3 is a perspective view showing an intermediate transfer belt and devices arranged therearound shown in FIG. 1.

Furthermore, as shown in FIG. 3, the intermediate transfer belt 10 is tensed by five cylindrical rollers comprised of a belt charger roller 17 arranged so as to oppose to the belt corona charger 12, a pressing roller 18 arranged so as to oppose to the photoconductive drum 6, a secondary transfer roller 19, a belt cleaner roller 20, and a tension roller 14, so that the dielectric layer 10*b* of the belt 10 opposes to the photoconductive drum 6. The pressing roller 18 is moved by a solenoid 21 between a first position P1 for pressing the intermediate transfer belt 10 onto the surface of the photoconductive drum 6 at a primary transfer position PT and a second position P2 for keeping the intermediate transfer belt 10 apart from the photoconductive drum 6. The belt cleaner 16 is moved by a solenoid 22 between a first position for contacting with the intermediate transfer belt 10 and a second position at which the belt cleaner 16 is kept apart from the intermediate transfer belt 10.

Paper feeding cassettes 23 for feeding a copying paper S are arranged on the left hand side of the secondary transfer charger 13, and the copying paper S sent by a paper feeding roller 23*a* is sent by a timing roller 24 to a secondary transfer position ST of the intermediate transfer belt 10 positioned above the secondary transfer charger 13. A copying paper transportation belt 25 is arranged on the right hand side of the secondary transfer charger 13 and the separating charger 13*a*, and the copying paper S after the secondary transfer process is transported to a fixing unit 26 by the copying paper transportation belt 25. After the fixing unit 26 fixes the toner image transferred on the copying paper S, the copying paper S is discharged onto a paper tray 27.

Actions of the full color copying machine constructed as described above will be described hereinafter.

The document set on the glass document table 1 is scanned by the optical scanner in a horizontal direction, and the light reflected by the document is incident onto a photoconductive surface 6*a* of the rotating photoconductive drum 6 via the first to third mirrors 3*a* to 3*c*, the color filter unit 5, the focus lens 4, and the fourth and fifth mirrors 3*d* and 3*e*, to form a latent image of the document. Upon forming the latent image, the surface 6*a* of the photoconductive drum 6 is exposed to discharge it by the eraser lamp 7, and is electrified to have a predetermined electric potential such as a negative electric potential by the corona charger 8. When it is exposed to the above light reflected by the document in the electrified state while the photoconductive drum 6 is rotated in the clockwise direction indicated by the arrow R as shown in FIG. 1 in synchronous with the above scan operation, the electric potential of the photoconductive surface 6*a* varies according to the intensity thereof, resulting in that an electrostatic latent image corresponding to a color image of the document filtered by either one of the filter plates 5B, 5G and 5R of the color filter unit 5 is formed thereon.

Then, the electrostatic latent image is developed in a visible color toner image with a color toner supplied from the selected one of the yellow developing unit 9Y, the magenta developing unit 9M, and the cyan developing unit 9C. For example, when the blue color filter plate 5B of the color filter unit 5 is positioned on the way of the aforementioned optical path, the yellow developing unit 9Y for supplying the yellow toner being complementary color of blue color. Then, in the other developing units 9M and 9C not selected, toner supplied on the developing sleeve 9*a* is scraped off by the scraping shutter member 9*b* arranged at the rear of the developing sleeve 9*a* so as not to be supplied to the photoconductive drum 6. Thereafter, when the selected yellow developing unit 9Y is driven so as to supply a yellow toner to the surface of the photoconductive drum 6, the above electrostatic latent image is developed in a visible yellow toner image. It is to be noted that the toner to be supplied to the photoconductive drum 6 is previously electrified to have a predetermined electric potential such as a positive electric potential, which is opposite to that of the photoconductive drum 6.

Figure 5:
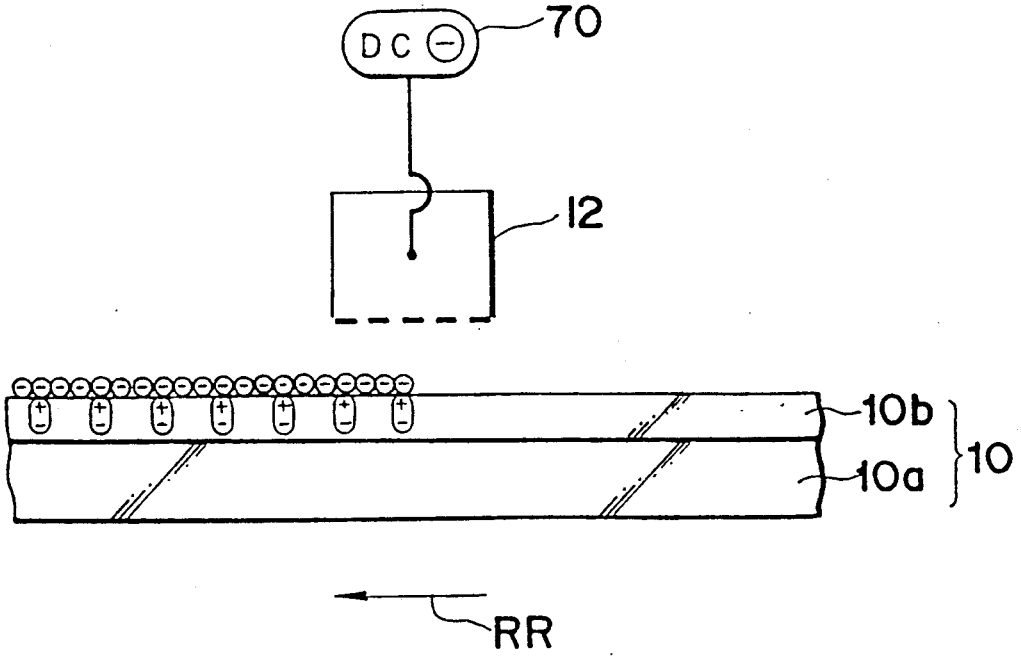
FIG. 5 is an enlarged longitudinal cross sectional view showing an electrifying state of the intermediate transfer belt shown in FIGS. 1, 3 and 4.

The intermediate transfer belt 10 is driven in a direction indicated by an arrow RR in synchronous with the rotation of the photoconductive drum 6 at the same velocity as the rotation velocity of the photoconductive drum 6, and when the intermediate transfer belt 10 passes the belt corona charger 12 positioned before the primary transfer position PT, it is electrified as shown in FIG. 5. A negative voltage is applied to the belt corona charger 12 by a direct-current voltage source 70, and the dielectric layer 10*b* of the intermediate transfer belt 10 is electrified to have a negative electric potential by the belt corona charger 12 only in the primary transfer process for the first time, even in the case of a multiple transfer process for forming a plurality of color images. In the electrifying operation, since the surface of the dielectric layer 10*b* is directly electrified, it can done at a high efficiency. A negative electric potential is formed uniformly on the surface of the dielectric layer 10*b* by the above electrifying operation. This state is stabilized by a backup of the conductive substrate 10*a* formed at the back side of the dielectric layer 10*b*, and the above state can be maintained for a relatively long time without any influence of the environment. Furthermore, the transfer processes of times required for forming a plurality of color images can be performed properly by the aforementioned one electrifying operation of the belt corona charger 12.

On the other hand, at the primary transfer position PT, the pressing roller 18 presses the intermediate transfer belt 10 on the photoconductive drum 6 by the action of the solenoid 21.

Figure 6:
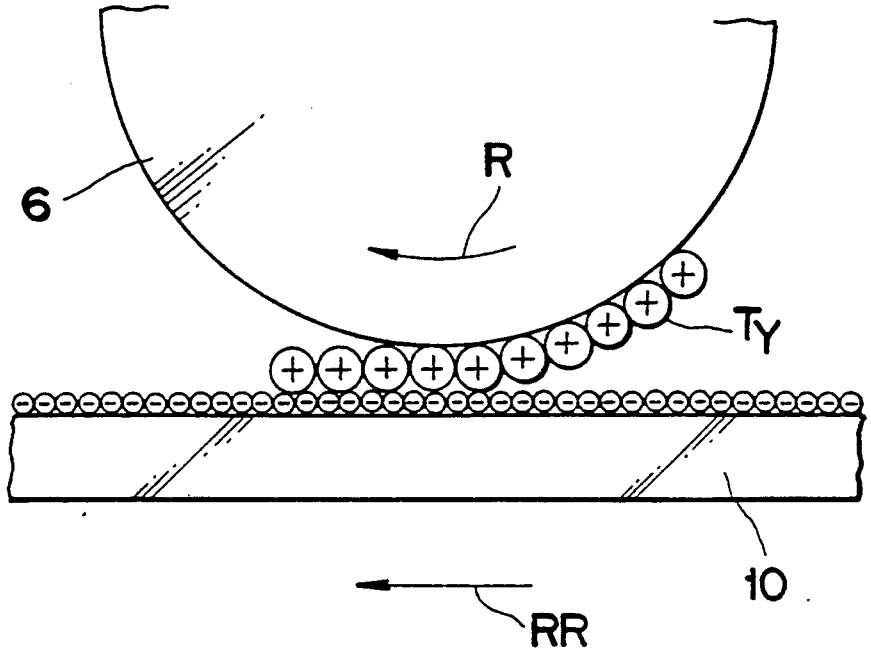
FIGS. 6 to 8 are enlarged partial cross sectional views for showing a primary transfer process of respective color toner images at a primary transfer position PT in the full color copying machine shown in FIG. 1.

When an electrified portion of the intermediate transfer belt 10 reaches the primary transfer position PT in the above state, the yellow toner image $T_Y$ having a positive electric potential is transferred from the photoconductive drum 6 onto the intermediate transfer belt 10 having the negative electric potential electrified, as shown in FIG. 6. The above transfer process is performed without the action of the corona charger 12 because the corona charger 12 is remote from the primary transfer position PT, however, the toner image is transferred due to the stabilized electric potential given onto the intermediate transfer belt 10, without any jitter of image due to the previous transfer process. Since the multiple transfer process for forming a plurality of color images can be performed by the above one electrifying operation onto the intermediate transfer belt 10, ozone due to the action of the belt corona charger 12 can be prevented from generating so as to prevent an influence into the image by a decreased amount of ozone corresponding to the electrifying operations of decreased times. Furthermore, when the above electrifying operation is performed every primary transfer process, the toner image formed on the intermediate transfer belt 10 is also electrified with the intermediate transfer belt 10 to have an electric potential having the same polarity as that of the belt 10, resulting in that it is supposed that such a reverse transfer may be caused that the toner image formed on the intermediate transfer belt 10 is transferred reversely onto the photoconductive drum 6. However, in the present preferred embodiment, the above reverse transfer is never caused. The electric potential of the intermediate transfer belt 10 to be electrified in the above one electrifying operation is set so that the negative electric potential thereof can be maintained to a higher electric potential than the negative electric potential of the photoconductive drum 6 in the last primary transfer process of the multiple transfer process. Accordingly, in the multiple transfer processes, each primary transfer process can be performed properly at all times. Thereafter, the photoconductive surface 6a of the photoconductive drum 6 is cleaned by the drum cleaner 11, and thereby, the primary transfer process is completed.

Figure 7:
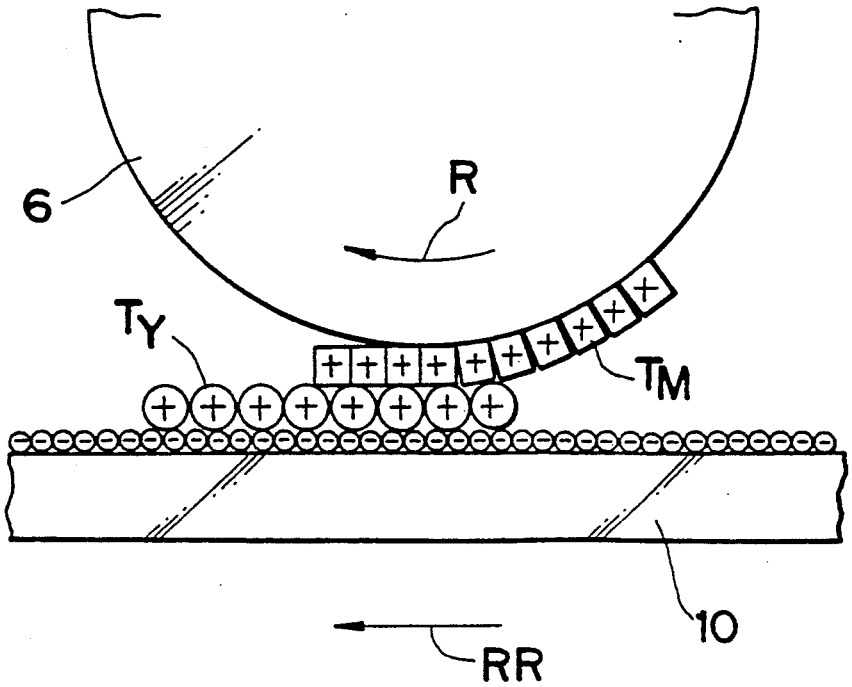

In the case of a full color copying operation, after the process for the first time comprised of the exposure, the development and the primary transfer with respect to the yellow image of the document is completed, the green color filter plate 5G of the color filter unit 5 is selected so as to be positioned on the way of the aforementioned optical path, the photoconductive surface 6a of the photoconductive drum 6 is exposed to a light passed through the green color filter plate 5G so that an electrostatic latent image corresponding to a magenta component of the document image is formed thereon. The electrostatic latent image is developed in a visible magenta toner image by the magenta developing unit 9M for supplying the magenta toner being complementary color of green light. At the same time, the intermediate transfer belt 10 on which the yellow toner image $T_Y$ has been formed is pressed on the photoconductive drum 6 again, so that the magenta toner image $T_M$ is transferred onto the yellow toner image $T_Y$ as shown in FIG. 7 as well as the primary transfer process for the yellow toner image $T_Y$, because the electric potential of the intermediate transfer belt 10 is maintained to a predetermined value.

Figure 8:
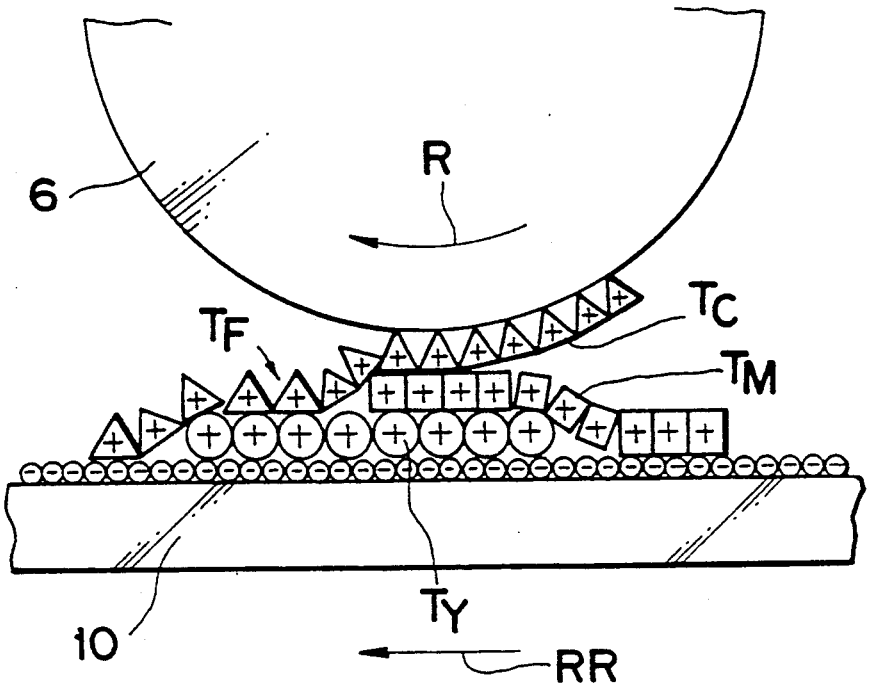

After the aforementioned process for the second time comprised of the exposure, the development and the primary transfer with respect to the magenta image of the document is completed, the third red color filter plate 5R of the color filter unit 5 is selected so as to be positioned on the way of the aforementioned optical path, the photoconductive surface 6a of the photoconductive drum 6 is exposed to a light passed through the red color filter plate 5R so that an electrostatic latent image corresponding to a cyan component of the document image is formed thereon. The electrostatic latent image is developed in a visible cyan toner image by the cyan developing unit 9C for supplying the cyan toner being complementary color of red light. At the same time, the intermediate transfer belt 10 on which the yellow toner image $T_Y$ and the magenta toner image $T_M$ are transferred is pressed on the photoconductive drum 6 again, so that the cyan toner image $T_C$ is formed on the yellow and magenta toner images $T_Y$ and $T_M$ as shown in FIG. 8 as well as the above primary transfer process for the toner images $T_Y$ and $T_M$, because the electric potential of the intermediate transfer belt 10 is maintained to a predetermined value, resulting in that the full color toner image $T_F$ comprised of the yellow, magenta and cyan toner images $T_Y$, $T_M$ and $T_C$ is formed thereon.

During the above primary transfer process, the solenoid 22 is turned off so that the belt cleaner 16 is kept apart from the intermediate transfer belt 10. On the other hand, at a timing when the above primary transfer process is completed, the solenoid 21 is turned off so that the pressing roller 18 is moved to detach the intermediate transfer belt 10 from the photoconductive drum 6, and then, the intermediate transfer belt 10 is driven to rotate in the direction indicated by the arrow RR in this state. Thus, since the intermediate transfer belt 10 is detached from the photoconductive drum 6 except for the primary transfer process, the rotation operation of the photoconductive drum 6 is stopped when the primary transfer process has been completed. Since the photoconductive drum 6 is separated from the intermediate transfer belt 10, it can be prevented from being marred and the electrical fatigue can be prevented due to the friction which might cause the electrification and discharge of the photoconductive drum 6 repeatedly if they were contacted with each other.

Figure 9:
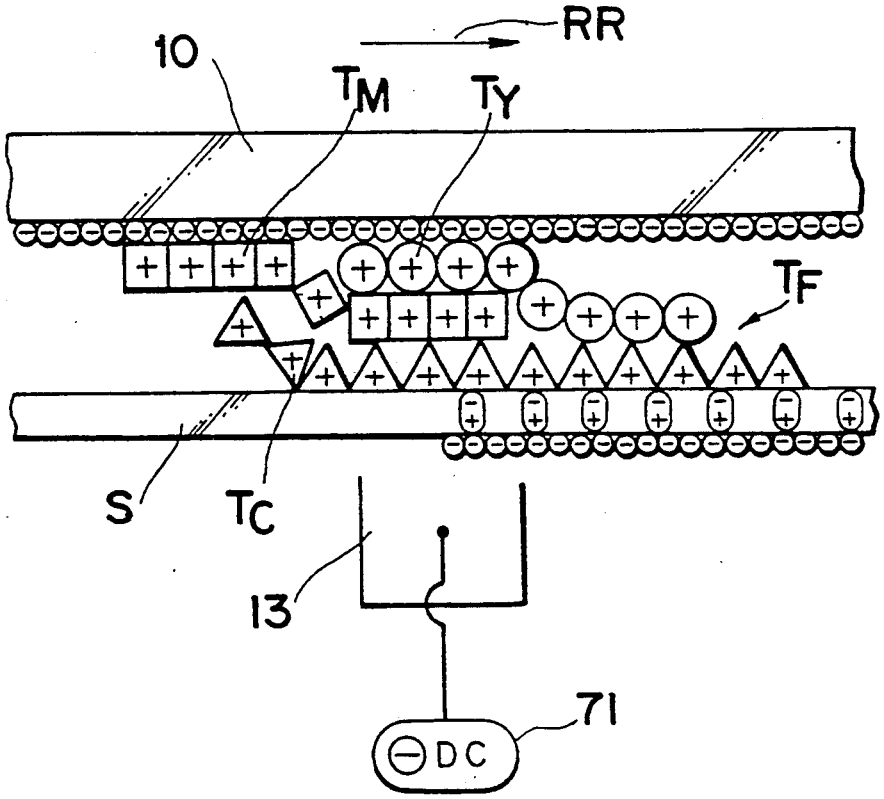
FIG. 9 is an enlarged partial cross sectional view for showing a secondary transfer process of a full color toner image at a secondary transfer position ST in the full color copying machine shown in FIG. 1.

On the other hand, at a predetermined timing when a signal is outputted from a position detection unit (not shown) for detecting the position of the intermediate transfer belt 10, a copying paper S is sent from the paper feeding cassette 23 by the paper feeding roller 23a, and then, at the next predetermined timing, the copying paper S is sent to the secondary transfer position ST positioned above the secondary transfer charger 13 by the timing roller 24. At that time, the copying paper S is electrified to have a negative electric potential by the secondary transfer charger 13 to which a negative direct-current voltage is applied by a voltage source 71 as shown in FIG. 9, and then, the full color toner image $T_F$ having a positive electric potential which is formed on the intermediate transfer belt 10 is absorbed electrostatically, and thereby, transferred onto the copying paper S.

Figure 10:
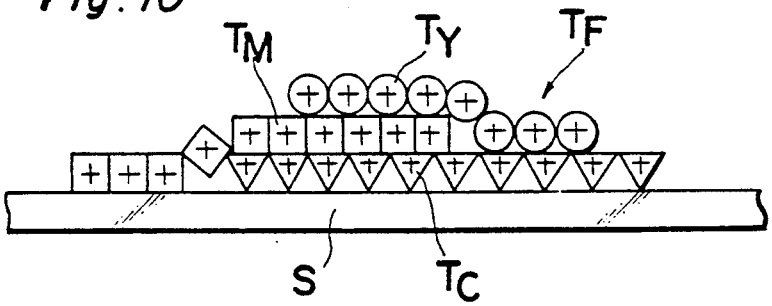
FIG. 10 is an enlarged partial cross sectional view of a copying paper on which a full color image has been transferred.

After an alternating-current voltage is applied by the separating charger 13a to the copying paper S on which the toner image $T_F$ is transferred as shown in FIG. 10 so that the copying paper S is discharged, the copying paper S is separated from the intermediate transfer belt 10, and is absorbed and is transported by the copying paper transportation belt 25. Thereafter, the copying paper S is sent to the fixing unit 26, and the toner image $T_F$ formed on the copying paper S is fixed, and then, the copying paper S is exhausted to the paper tray 27.

On the other hand, after the secondary transfer process is completed, the intermediate transfer belt 10 is discharged by the belt discharger 13, and is cleaned by the belt cleaner 16 when the solenoid 22 is turned on, and then, the intermediate transfer belt 10 becomes a standby state for the next process.

Figure 11:
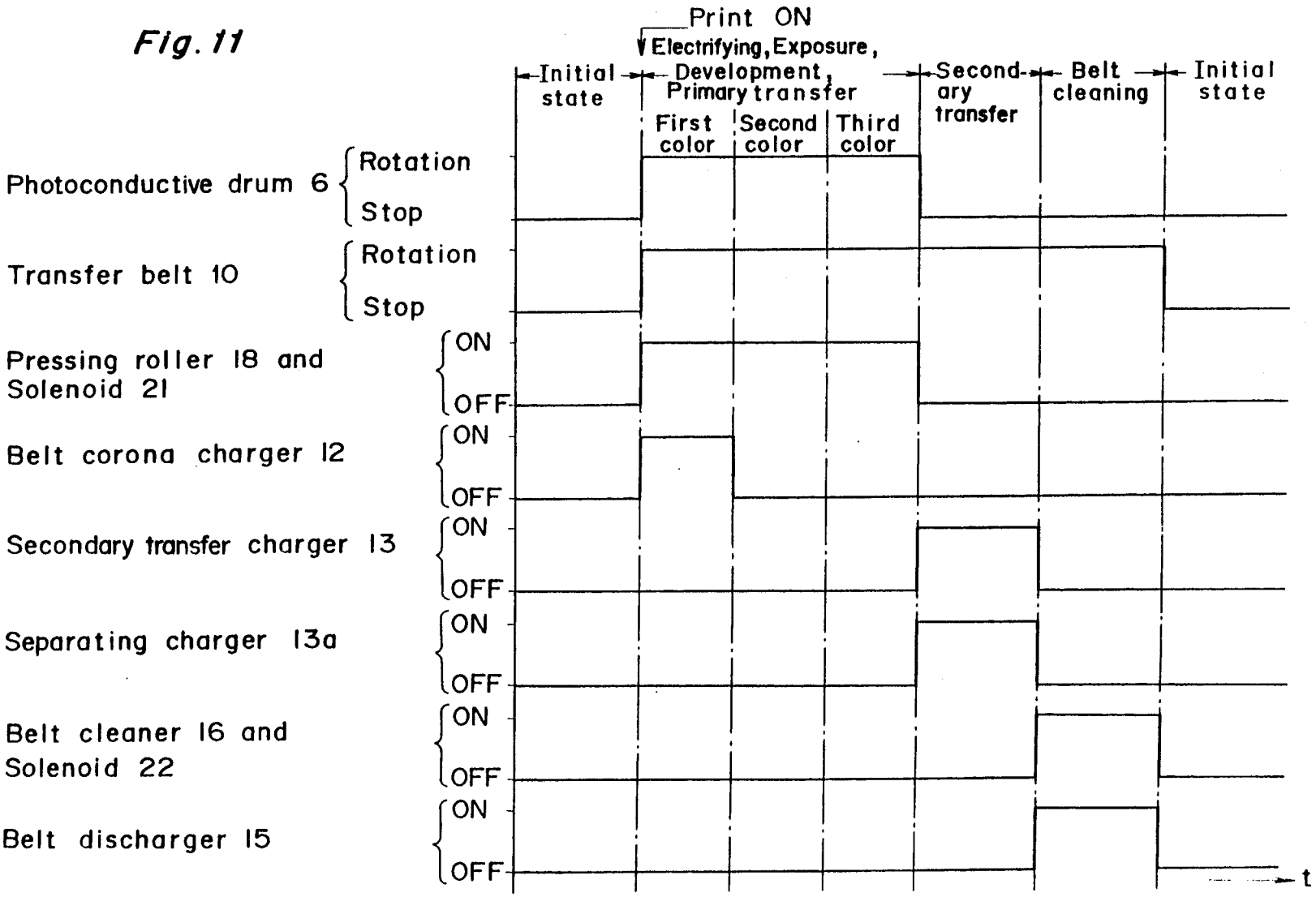
FIG. 11 is a timing chart showing actions of the full color copying machine shown in FIG. 1.

The operation timings of the photoconductive drum 6, the intermediate transfer belt 10, the solenoids 21 and 22, the belt cleaner 16, respective chargers 12, 13, 13a and 15, and the pressing roller 18 are shown in FIG. 11.

The Second Preferred Embodiment

Figure 13:
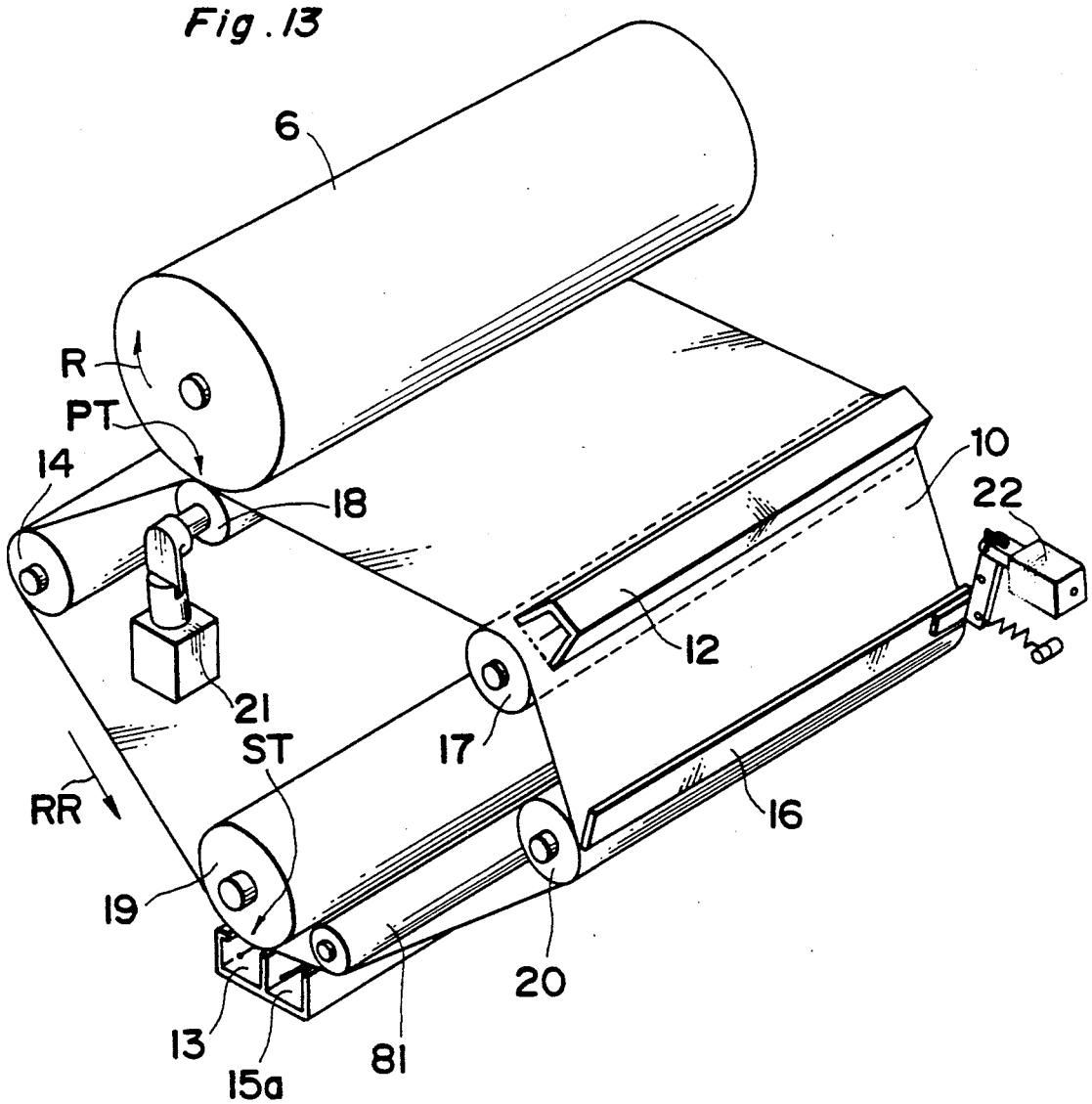
FIG. 13 is a perspective view showing an intermediate transfer belt and devices arranged therearound shown in FIG. 12.
Figure 12:
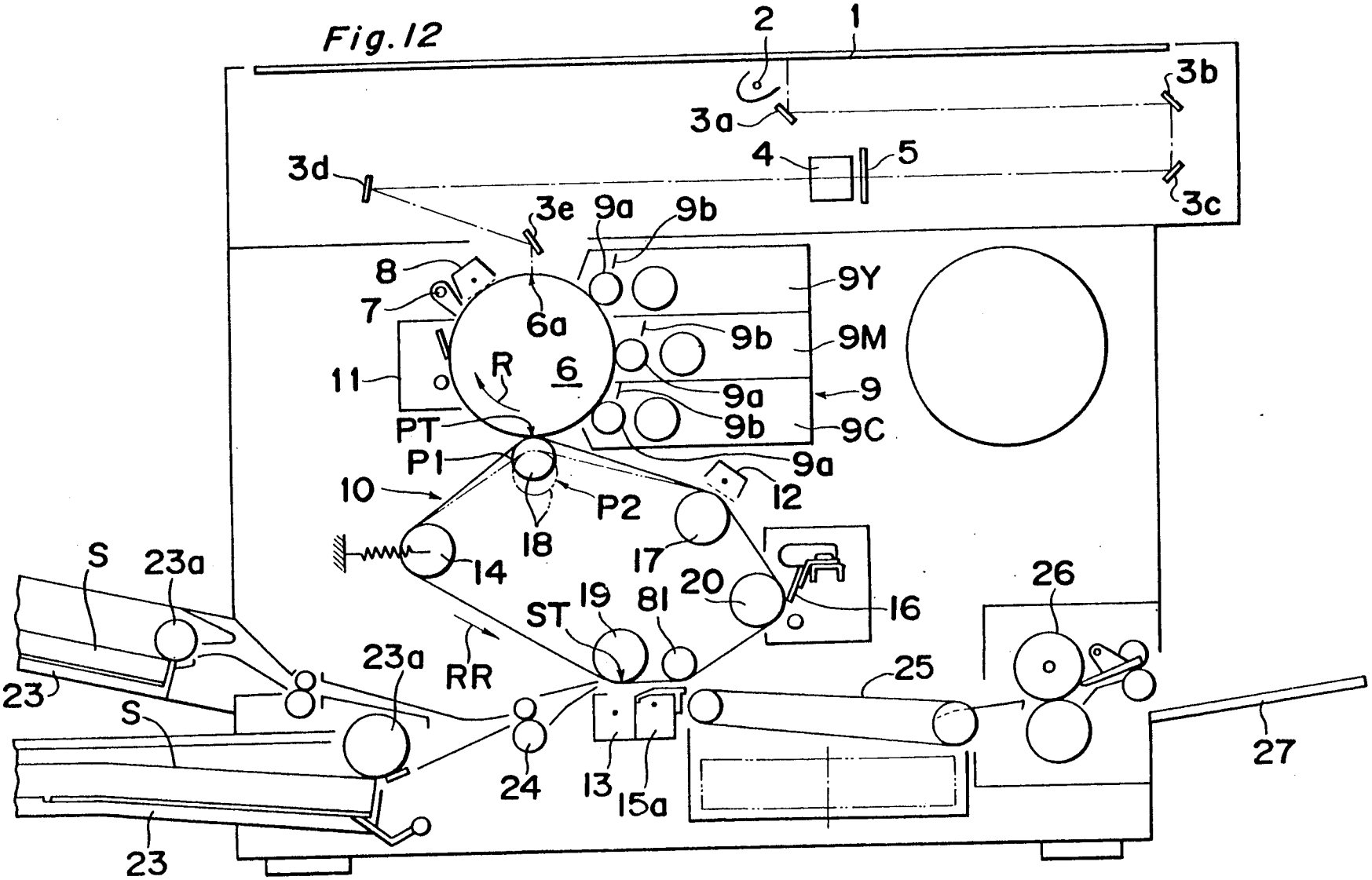
FIG. 12 is a schematic longitudinal cross sectional view showing a full color copying machine of the second preferred embodiment according to the present invention.

FIG. 12 is a schematic longitudinal cross sectional view showing a full color copying machine of the second preferred embodiment according to the present invention, and FIG. 13 is a perspective view showing the intermediate transfer belt 10 and units arranged therearound in the full color copying machine. In FIGS. 12 and 13, the same components as those shown in FIGS. 1 and 3 are designated by the same numerals as those shown in FIGS. 1 and 3, respectively. The differences between the second and first preferred embodiments will be mainly described hereinafter, referring to FIGS. 12 and 13.

A discharger 15*a* for discharging the copying paper S and the intermediate transfer belt 10 is arranged on the right hand side of the secondary transfer charger 13 in place of the separating charger 13*a* and the belt discharger 15 shown in FIGS. 1 and 3, wherein an alternating-current voltage is applied to the discharger 15*a*. The intermediate transfer belt 10 is tensed by six cylindrical rollers comprised of an auxiliary roller 81 arranged between the rollers 19 and 20 in addition to the rollers 14 and 17 to 20 as shown in FIG. 13 in detail, wherein the intermediate transfer belt 10 is made to be close to the discharger 15*a* by a guide operation of the auxiliary roller 81, so that the discharger 15*a* discharges the intermediate transfer belt 10 effectively.

In the full color copying machine constructed as described above, after the secondary transfer process, an alternating-current voltage is applied by the discharger 15*a* to the copying paper S on which the toner image $T_F$ is formed as shown in FIG. 10 so that the copying paper S is discharged, and also the intermediate transfer belt 10 is discharged by the discharger 15*a*. The full color copying machine operates the same as the full color copying machine of the first preferred embodiment, except for the operations of the discharger 15*a* and the auxiliary roller 81.

Figure 14:
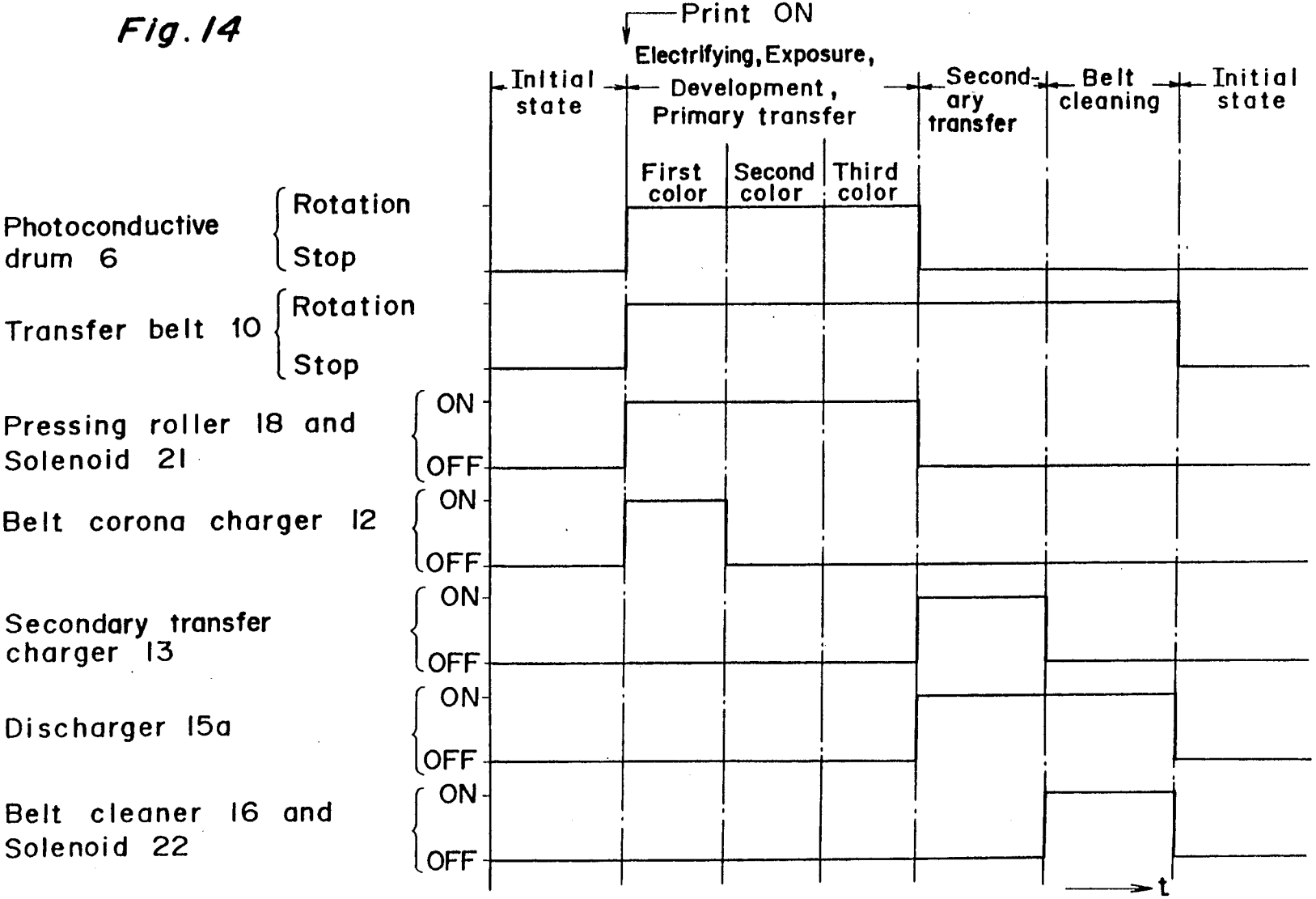
FIG. 14 is a timing chart showing actions of the full color copying machine shown in FIG. 12.

The operation timings of the photoconductive drum 6, the intermediate transfer belt 10, the solenoids 21 and 22, the belt cleaner 16, respective chargers 12, 13, and 15*a*, and the pressing roller 18 are shown in FIG. 14.

The Third Preferred Embodiment

Figure 15:
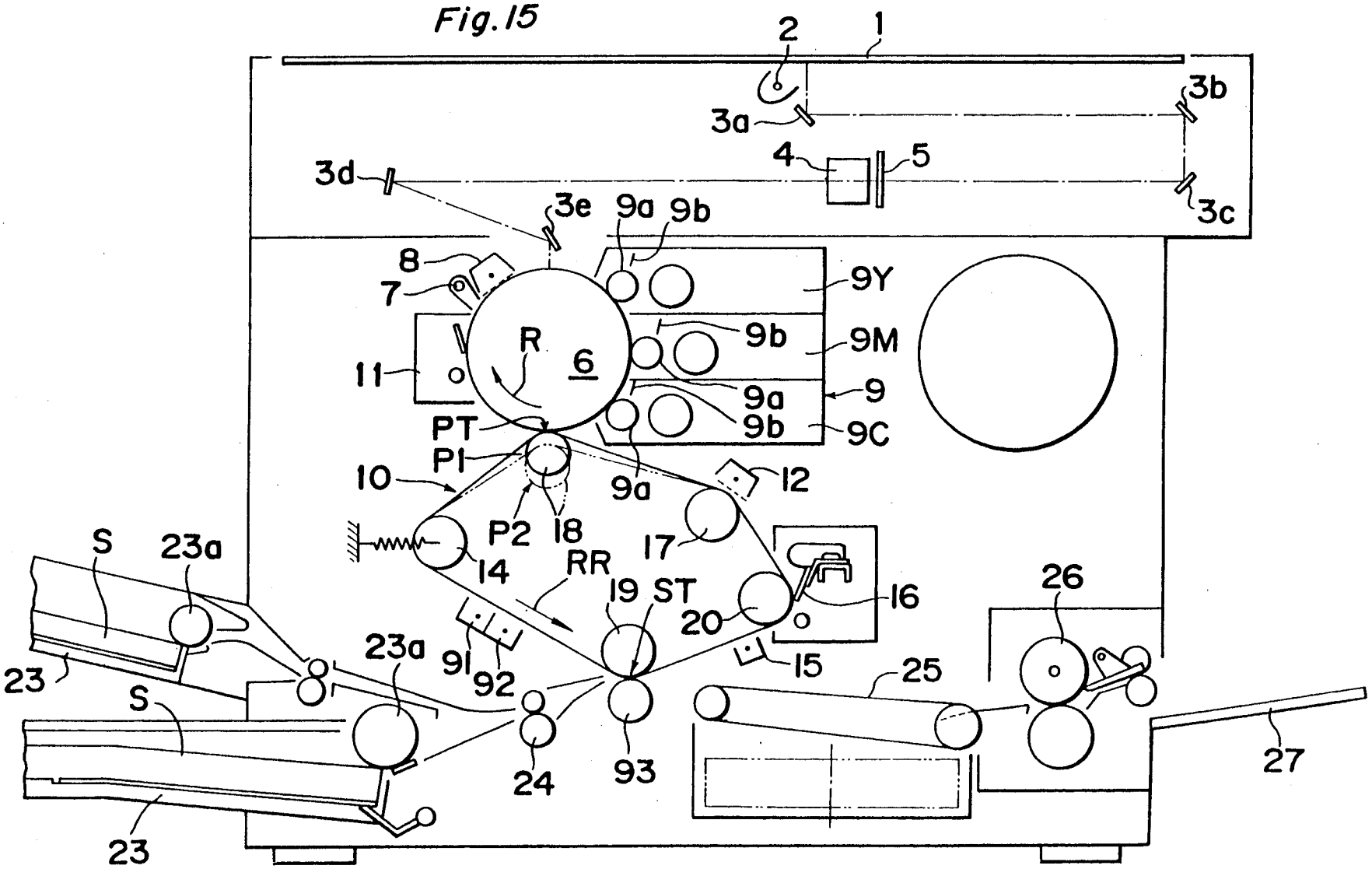
FIG. 15 is a schematic longitudinal cross sectional view showing a full color copying machine of the third preferred embodiment according to the present invention.
Figure 16:
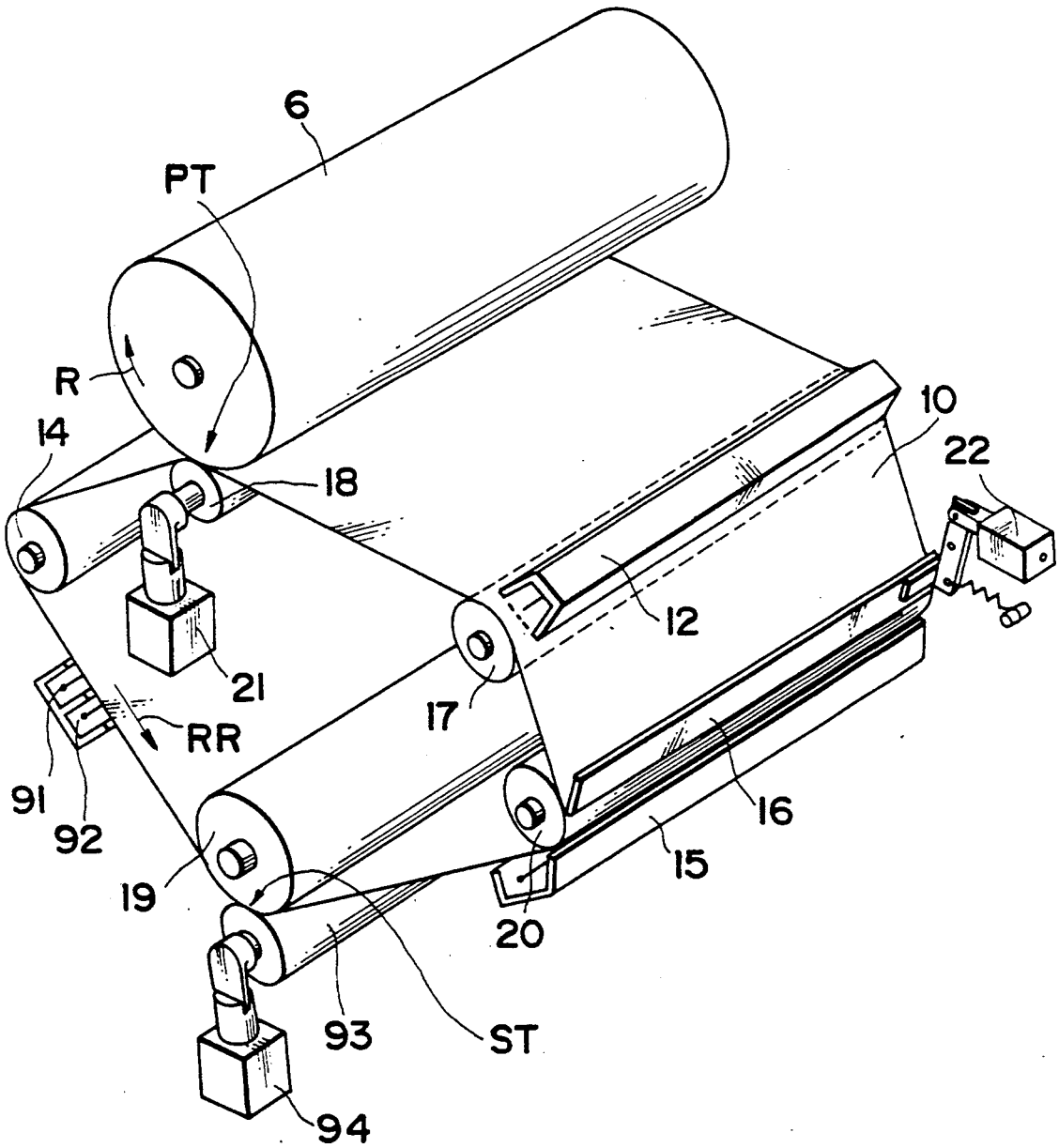
FIG. 16 is a perspective view showing an intermediate transfer belt and devices arranged therearound shown in FIG. 15.

FIG. 15 is a schematic longitudinal cross sectional view showing a full color copying machine of the third preferred embodiment according to the present invention, and FIG. 16 is a perspective view showing the intermediate transfer belt 10 and units arranged therearound in the full color copying machine. In FIGS. 15 and 16, the same components as those shown in FIGS. 1 and 3 are designated by the same numerals as those shown in FIGS. 1 and 3, respectively. The differences between the third and first preferred embodiments will be mainly described hereinafter, referring to FIGS. 15 and 16.

A pressing transfer roller 93 for transferring a toner image formed on the intermediate transfer belt 10 onto the copying paper S is arranged around the intermediate transfer belt 10 so as to oppose to the secondary transfer roller 19, in place of the secondary transfer charger 13 and the separating charger 13*a*. The pressing transfer roller 93 is moved by a solenoid 94, so that the pressing transfer roller 93 is pressed onto the intermediate transfer belt 10 when the solenoid 94 is turned on and the pressing transfer roller 93 is kept apart from the intermediate transfer belt 10 when the solenoid 94 is turned off. A discharger 91 and charger 92 for performing a previous process before the secondary transfer process are arranged sequentially around the intermediate transfer belt 10 and at a position between the primary transfer position PT and the secondary transfer position ST.

Figure 17:
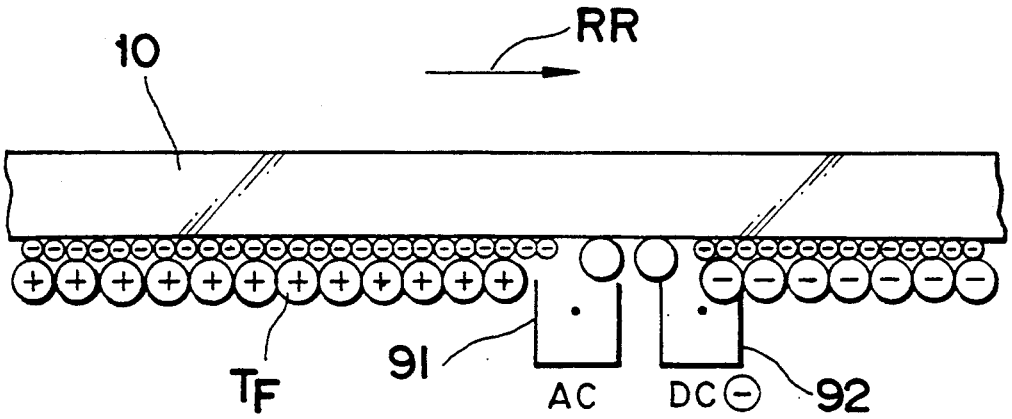
FIG. 17 is an enlarged partial cross sectional view of the intermediate transfer belt for showing a previous process for a full color toner image before a secondary transfer process in the full color copying machine shown in FIG. 15.

In the full color copying machine constructed as described above, during the primary transfer process, the solenoid 94 is turned off so that the pressing transfer roller 93 is kept apart from the intermediate transfer belt 10. On the other hand, when the intermediate transfer belt 10 is moved from the primary transfer position PT to the secondary transfer position ST, as shown in FIG. 17, the surface of the dielectric layer 10*b* of the intermediate transfer belt 10 and the full color toner image $T_F$ are discharged by the discharger 91 and are electrified uniformly to have a predetermined negative electric potential by the charger 92. At the same time, at a predetermined timing when a signal is outputted from a position detection unit (not shown) for detecting the position of the intermediate transfer belt 10, a copying paper S is sent from the paper feeding cassette 23 by the paper feeding roller 23*a*, and then, at the next predetermined timing, the copying paper S is sent to the secondary transfer position ST positioned between the rollers 19 and 93. At that time, as shown in FIG. 18, the copying paper S is pressed to the intermediate transfer belt 10 positioned between the secondary transfer roller 19 and the pressing transfer roller 93 which is pressed thereto by the action of the solenoid 74 turned on, so that the full color toner image $T_F$ having a negative electric potential formed on the intermediate transfer belt 10 is transferred onto the copying paper S.

When the copying paper S on which the toner image $T_F$ is transferred leaves the secondary transfer position ST, it is bent and is separated from the intermediate transfer belt 10, and then, it is absorbed and is transported to the fixing unit 26 by the copying paper transportation belt 25 under condition that the full color toner image $T_F$ is retained thereon as shown in FIG. 10.

Figure 18:
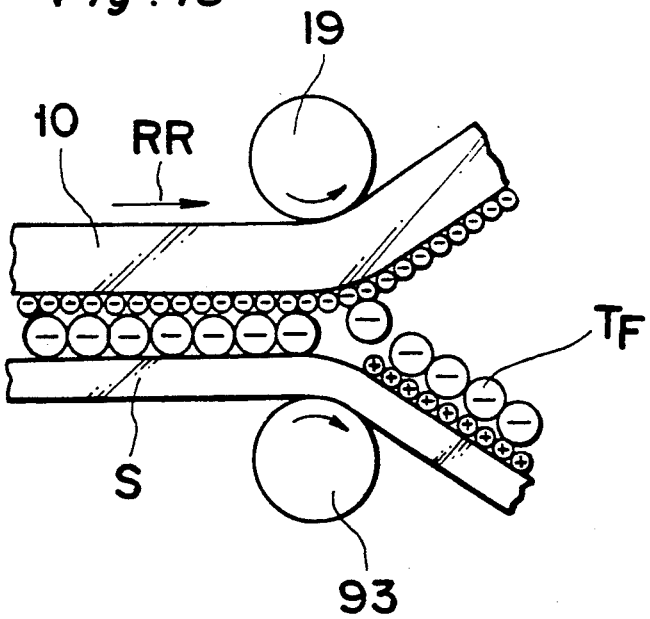
FIG. 18 is an enlarged partial cross sectional view of the intermediate transfer belt and the copying paper for showing the secondary transfer process of the full color toner image at the secondary transfer position ST in the full color copying machine shown in FIG. 15.

When the copying paper S is bent and is separated from the intermediate transfer belt 10, it is electrified by a friction caused between the intermediate transfer belt 10 and the copying paper S as shown in FIG. 18, and the full color toner image $T_F$ formed on the intermediate transfer belt 10 is transferred easily and is retained certainly on the copying paper S by an absorption action for the full color toner image $T_F$ having a positive electric potential.

The operation timings of the photoconductive drum 6, the intermediate transfer belt 10, the solenoids 21, 22 and 94, the belt cleaner 16, respective chargers 12, 15, 91 and 92, the belt pressing roller 18, and the pressing transfer roller 93 are shown in FIG. 19.

THE OTHER MODIFICATIONS

In the above preferred embodiments, the photoconductive drum 6 and the intermediate transfer belt 10 are electrified to have a negative electric potential, and the toners are electrified to have a positive electric potential. However, the photoconductive drum 6 and the intermediate transfer belt 10 may be electrified to have a positive electric potential, and the toners may be electrified to have a negative electric potential.

In the above preferred embodiments, the primary transfer process is performed three times on the intermediate transfer belt 10 so that the full color toner image $T_F$ is formed thereon, and the full color toner image $T_F$ is transferred onto the copying paper S. However, a color image having a single color may be formed thereon and the color image may be transferred on a copying paper S.

In the above preferred embodiments, the intermediate transfer belt 10 is used as an intermediate transfer body, however, an intermediate transfer drum can be used in place of it.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. An image forming apparatus comprising:

a photoconductive member;

an electrostatic latent image forming means for forming an electrostatic latent image corresponding to an image of a document on said photoconductive member;

a developing means for developing the electrostatic latent image with a toner so as to from a visible toner image on said photoconductive member;

a toner image retaining member having an electrically conductive substrate and a dielectric layer formed on the electrically conductive substrate, said toner image retaining member retaining a toner image temporarily;

a primary transfer means for electrifying the dielectric layer of said toner image retaining member at an electrifying position and for bringing the electrified dielectric layer into contact with said photoconductive member at a transfer position which is apart from the electrifying position so as to transfer the toner image formed on said photoconductive member onto said toner image retaining member; and a secondary transfer means for transferring the toner image transferred on said toner image retaining member onto a paper.

2. The image forming apparatus as claimed in claim 1, further comprising:

a charger means for electrifying the dielectric layer of said the toner image retaining member and the toner image transferred on said toner image retaining member, before the toner image transferred on said toner image retaining member is transferred onto the paper by said secondary transfer means.

3. The image forming apparatus as claimed in claim 1, wherein the dielectric layer of said toner image retaining member has a specific inductive capacity of 2 to 4 and a volume resistivity of $10^{16}$ to $10^{17}$ Ω·cm.

4. The image forming apparatus as claimed in claim 1, wherein the electrically conductive substrate of said toner image retaining member has a volume resistivity of $10^5$ Ω cm or less.

5. An image forming apparatus comprising:

a photoconductive member;

an electrostatic latent image forming means for sequentially forming a plurality of electrostatic latent images corresponding to color components of an image of a document on said photoconductive member, respectively;

a developing means for developing the electrostatic latent images with toners of different colors so as to form the corresponding visible toner images on said photoconductive member, respectively;

a toner image retaining member having an electrically conductive substrate and a dielectric layer formed on the electrically conductive substrate, said toner image retaining member retaining toner images temporarily;

a primary transfer means for electrifying the dielectric layer of said toner image retaining member and bringing the electrified dielectric layer into contact with said photoconductive member so as to sequentially transfer the toner images formed on said photoconductive member onto said toner image retaining member so that a color toner image comprised of all the toner images is formed thereon; and a secondary transfer means for transferring the color toner image formed on said toner image retaining member onto a paper.

6. The image forming apparatus as claimed in claim 5, further comprising:

a charger means for electrifying the dielectric layer of said the toner image retaining member and the color toner image formed on said toner image retaining member, before the color toner image formed on said toner image retaining member is transferred onto the paper by said secondary transfer means.

7. The image forming apparatus as claimed in claim 5, wherein the dielectric layer of said toner image retaining member has a specific inductive capacity of 2 to 4 and a volume resistivity of $10^{16}$ to $10^{17}$ Ω·cm.

8. The image forming apparatus as claimed in claim 5, wherein the electrically conductive substrate of said toner image retaining member has a volume resistivity of $10^5$ Ω·cm or less.

9. A toner image retaining member for use in an image forming apparatus, comprising:

an electrically conductive substrate having a volume resistivity of $10^5$ Ω cm or less; and a dielectric layer formed on said electrically conductive substrate having a specific inductive capacity of 2 to 4, and a volume resistivity of $10^{16}$ to $10^{17}$ Ω·cm.

10. An image forming method using a toner image retaining member comprising an electrically conductive substrate and a dielectric layer formed on said electrically conductive substrate, said method comprising steps of:

sequentially forming electrostatic latent images corresponding to color components of an image of a document on a photoconductive member;

sequentially developing the electrostatic latent images with toners of different colors so as to form the corresponding visible toner images on said photoconductive member;

electrifying the dielectric layer of said toner image retaining member once;

sequentially transferring the toner images formed on said photoconductive member onto said toner image retaining member after the electrifying process so as to form a color image on said toner image retaining member by superimposing all of the toner images thereon; and transferring the color image formed on said toner image retaining member onto a paper.

11. An image forming apparatus comprising:

a photoconductive member;

an electrostatic latent image forming means for forming an electrostatic latent image corresponding to an image of a document on said photoconductive member;

a developing means for developing the electrostatic latent image with a toner so as to form a visible toner image on said photoconductive member;

a toner image retaining member formed in a form of an endless belt;

supporting means having a plurality of rollers for supporting said toner image retaining member, said rollers including a movable roller movably provided at a position opposing to said photoconductive member so as to selectively bring said toner image retaining member into contact with said photoconductive member;

a first transfer means including a charger device provided at a position opposing to one of said rollers for electrifying said image retaining member to have a predetermined electric potential, and a driving device for moving said movable roller so as to bring said toner image retaining member into contact with said photoconductive member for transferring the toner image formed on said photoconductive member onto said toner image retaining member; and a second transfer means for transferring the toner image formed on said toner image retaining member onto a paper.

12. An image forming apparatus comprising:

a photoconductive member;

an electrostatic latent image forming means for forming an electrostatic latent image corresponding to an image of a document on said photoconductive member;

a developing means for developing the electrostatic latent image with a toner so as to form a visible toner image on said photoconductive member;

a toner image retaining member;

a first transfer means including a charger device for electrifying said toner image retaining member so as to transfer the toner image formed on said photoconductive member onto said toner image retaining member at a first transfer position;

a second transfer means for bringing a paper into contact with said toner image retaining member so as to transfer the toner image formed on said toner image retaining member onto the paper at a second transfer position; and a means arranged at a position between said first and second transfer positions for discharging said toner image retaining member and electrifying the same with an opposite electric polarity to that of the electric charge generated by a friction caused between the paper and said toner image retaining member.

13. An image forming apparatus comprising:

a photoconductive member;

an electrostatic latent image forming means for forming an electrostatic latent image corresponding to an image of a document on said photoconductive member;

a developing means for developing the electrostatic latent image with a toner so as to form a visible toner image on said photoconductive member;

a toner image retaining member;

a first transfer means including a charger device for electrifying said toner image retaining member so as to transfer the toner image formed on said photoconductive member onto said toner image retaining member at a first transfer position;

a second transfer means for bringing a paper into contact with said toner image retaining member so as to transfer the toner image formed on said toner image retaining member onto the paper at a second transfer position;

an eraser means arranged on the downstream side of said second transfer means in a transportation direction of the paper for erasing the electric charge electrified on the paper; and a control means for controlling said eraser means so as to erase the electric charge remained on said toner image retaining member after the operation of said second transfer means.

14. An image forming apparatus comprising:

a photosensitive member;

means for forming an electrostatic latent image on the photosensitive member;

means for converting the electrostatic latent image formed on said photosensitive member into a visible toner image;

a toner image retaining member, said toner image retaining member having an electrically conductive substrate and a dielectric layer formed on the electrically conductive substrate;

a charger for electrifying the dielectric layer of said toner image retaining member at an electrifying position so to have a predetermined electric potential;

means for bringing said toner image retaining member electrified by said charger at said electrifying position into contact with said photosensitive member at a transfer position which is apart from said electrifying position so as to transfer the visible toner image from said photosensitive member onto said toner image retaining member; and means for transferring the visible toner image from said toner image retaining member onto a piece of paper.

15. An image forming apparatus as claimed in claim 14, wherein the dielectric layer of said toner image retaining member has a specific inductive capacity of 2 to 4 and a volume resistivity of $10^{16}$ to $10^{17}$ Ω·cm.

16. An image forming apparatus as claimed in claim 14, wherein the electrically conductive substrate of said toner image retaining member has a volume resistivity of $10^{5}$ Ω·cm or less.

* * * * *

UNITED STATES PATENT AND TRADEMARK OFFICE

CERTIFICATE OF CORRECTION

PATENT NO. : 5,099,286

DATED : March 24, 1992

INVENTOR(S) : Hideya Nishise, et al.

It is certified that error appears in the above-identified patent and that said Letters Patent is hereby corrected as shown below:

In col. 8, line 30, after "can" insert --be--.

In col. 13, line 52, (claim 4, line 4), change "Ω cm" to --Ω·cm--.

In col. 14, line 16, (claim 6, line 4), delete "the" (first occurrence).

In col. 14, line 33, (claim 9, line 4), change "Ω cm" to --Ω·cm--.

Signed and Sealed this

Twentieth Day of July, 1993

*Attest:*

Michael K. Kirk

MICHAEL K. KIRK

*Attesting Officer*

*Acting Commissioner of Patents and Trademarks*